US007980490B2

(12) United States Patent
Waddelow et al.

(10) Patent No.: US 7,980,490 B2
(45) Date of Patent: Jul. 19, 2011

(54) NOZZLE BODY APPARATUS

(75) Inventors: Simon Waddelow, Ely (GB); Robert Olson, Lino Lakes, MN (US)

(73) Assignee: Sta-Rite Industries, LLC, Delavan, WI (US)

( * ) Notice: Subject to any disclaimer, the term of this patent is extended or adjusted under 35 U.S.C. 154(b) by 0 days.

(21) Appl. No.: 11/904,615

(22) Filed: Sep. 27, 2007

(65) Prior Publication Data

US 2008/0087750 A1 Apr. 17, 2008

Related U.S. Application Data

(60) Provisional application No. 60/847,690, filed on Sep. 27, 2006.

(51) Int. Cl.
*A62C 31/02* (2006.01)

(52) U.S. Cl. ..... 239/394; 239/159; 239/166; 239/170; 239/392; 239/442; 239/76; 239/443; 239/550; 239/570; 239/600

(58) Field of Classification Search ..... 239/159, 239/166–168, 170, 76, 392, 394, 442–445, 239/548, 536, 550, 551, 570, 571, 600
See application file for complete search history.

(56) References Cited

U.S. PATENT DOCUMENTS

| | | | | |
|---|---|---|---|---|
| 3,455,510 | A | 7/1969 | Rotolico | |
| 3,863,841 | A * | 2/1975 | Berthoud | 239/444 |
| 4,058,260 | A * | 11/1977 | Lestradet | 239/394 |
| 4,915,305 | A | 4/1990 | O'Brien et al. | |
| 5,125,578 | A * | 6/1992 | Ballu | 239/394 |
| 5,441,203 | A | 8/1995 | Swan et al. | |
| 6,123,272 | A | 9/2000 | Havican et al. | |
| 6,152,388 | A | 11/2000 | Rohloff | |
| 6,250,564 | B1 | 6/2001 | Chahley | |
| 6,435,427 | B1 | 8/2002 | Conroy | |
| 6,669,120 | B2 | 12/2003 | Vernia | |
| 6,749,134 | B2 | 6/2004 | Arenson et al. | |
| 6,772,964 | B2 | 8/2004 | Funseth et al. | |
| 7,066,402 | B2 * | 6/2006 | Goebel et al. | 239/170 |
| 2004/0124283 | A1 | 7/2004 | Medici et al. | |
| 2004/0207199 | A1 | 10/2004 | Greco | |
| 2006/0108456 | A1 | 5/2006 | Beeren | |

FOREIGN PATENT DOCUMENTS

| | | |
|---|---|---|
| DE | 19924210 | 8/1999 |
| DE | 19816231 | 2/2000 |
| EP | 1506820 | 8/1984 |
| EP | 1254723 | 11/2002 |
| EP | 1262101 | 12/2002 |
| EP | 1419825 | 5/2004 |
| EP | 1469246 | 10/2004 |
| JP | 7016501 | 1/1995 |

* cited by examiner

*Primary Examiner* — Steven J Ganey
(74) *Attorney, Agent, or Firm* — Quarles & Brady, LLP

(57) ABSTRACT

Embodiments of the invention provide a nozzle body including a main body, a turret, a valve assembly, and a feed spigot. The feed spigot can be in fluid communication with a valve chamber via a first feed point and a second feed point. The use of multiple feed points between the feed spigot and the valve chamber can result in increased flow capacity.

12 Claims, 2 Drawing Sheets

NOZZLE BODY APPARATUS

RELATED APPLICATIONS

This application claims priority to U.S. Provisional Application No. 60/847,690, filed Sep. 27, 2006, the entire content of which is incorporated herein by reference.

BACKGROUND OF THE INVENTION

An agricultural crop spraying machine is designed to effectively distribute an agro-chemical spray over the largest area of crop in the least amount of time. The conventional design for such a machine is a wheeled base unit, be it trailed or self-propelled, which carries a tank, pump, and controls. The conventional design supplies the agro-chemical to the distribution booms extending from either side of the wheeled base unit, perpendicular to the direction of travel.

Nozzle holders (or nozzle bodies) are placed at regular intervals along the spray boom. The primary role of the nozzle holders is to provide a sealed connection between the pipe work of the boom supply and the spray nozzles distributing the agro-chemical. The nozzle holders also position the spray nozzles at the correct angle with respect to the direction of travel.

Some conventional nozzle holders include a check valve to ensure that the spray nozzles do not operate until sufficient line pressure is present to generate an acceptable spray. A diaphragm check valve for conventional nozzle holders has almost become a standard size, which allows accessory items, such as air operated shut-off valves, to be retrofitted.

Some conventional nozzle holders can receive different types of spray nozzles, so the operator can select the most appropriate combination of spray nozzles for a given application without the need for component changes.

In recent years, there has been a growing trend toward machines with a higher flow rate capacity to allow spraying needs to be increased while maintaining application rates per unit area. Although machine components can be increased in size to achieve increased flow capacities, there is particular emphasis directed at keeping the size and/or weight of the boom components to a minimum. This is necessary to minimize the potential for grounding and loading on the booms.

SUMMARY OF THE INVENTION

Embodiments of the invention provide a nozzle body including a main body, a turret, a valve assembly, and a feed spigot. The feed spigot can be in fluid communication with a valve chamber via a first feed point and a second feed point. The use of multiple feed points between the feed spigot and the valve chamber can result in increased flow capacity.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings.

Figure 1:
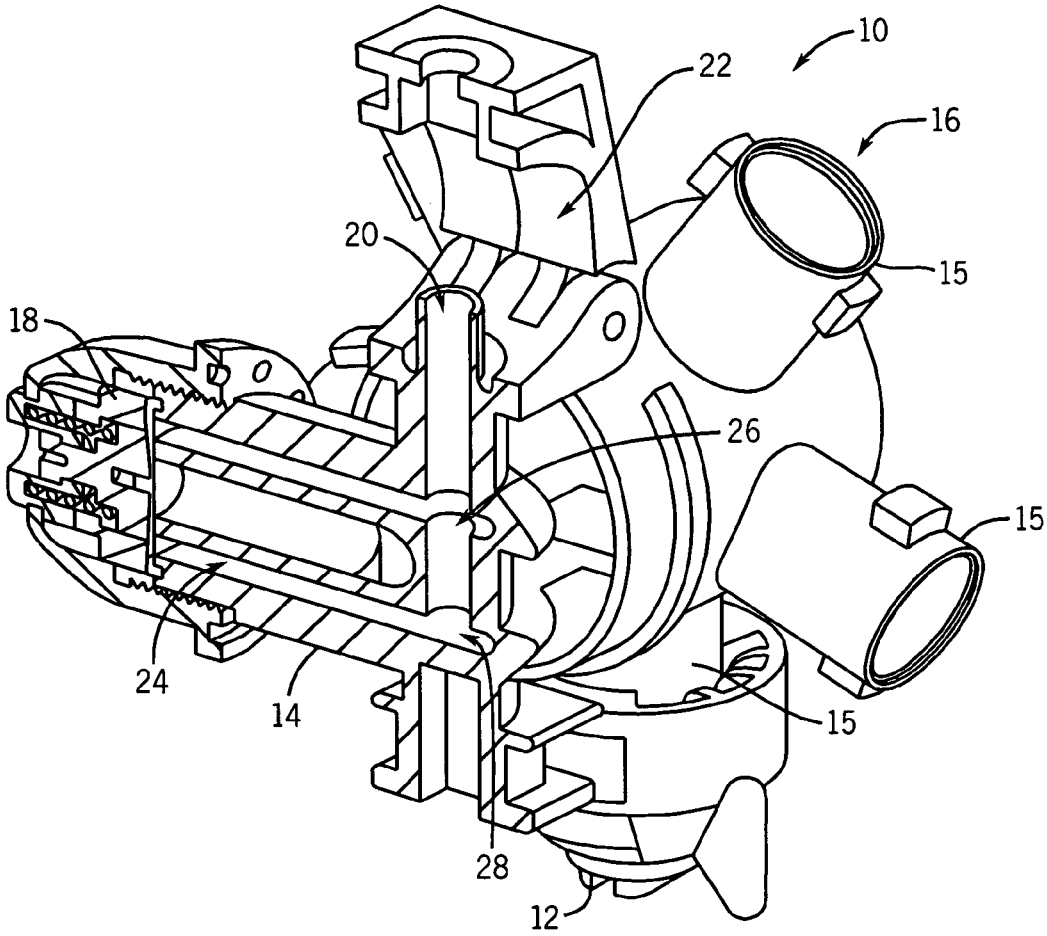
FIG. 1 is a cross-sectional perspective view of a nozzle body according to one embodiment of the invention.

FIG. 1 illustrates a nozzle body 10 according to one embodiment of the invention. The nozzle body 10 can include a main body 14, a turret 16, a valve assembly 18, a feed spigot 20, and a pipe clamp 22. One spray nozzle 12 is shown as an example attached to a port 15 of the turret 16 of the nozzle body 10. In some embodiments, the turret 16 can include three, four, or five ports 15 to receive a corresponding number of spray nozzles 12. In some embodiments, the turret 16 can be a multi-port indexable turret. In some embodiments, the valve assembly 18 can be a diaphragm check valve assembly. The feed spigot 20 can be in fluid communication with the pipe (not shown) of the boom (not shown). The pipe clamp 22 can secure the nozzle body 10 to the pipe of the boom. The feed spigot 20 can also be in fluid communication with a valve chamber 24 via a first or upper feed point 26 and a second or lower feed point 28. The use of multiple feed points between the feed spigot 20 and the valve chamber 24 can result in increased flow capacity with little change in dimensional envelope and substantially no change in the geometry of the diaphragm check valve assembly 18. In some embodiments, the first feed point 26 and the second feed point 28 can break into the valve chamber 14 at both the top side and the bottom side, respectively. This can allow greater flow rates and can be achieved with the feed spigot 20 and the main body 14 being a single molded piece.

Figure 2:
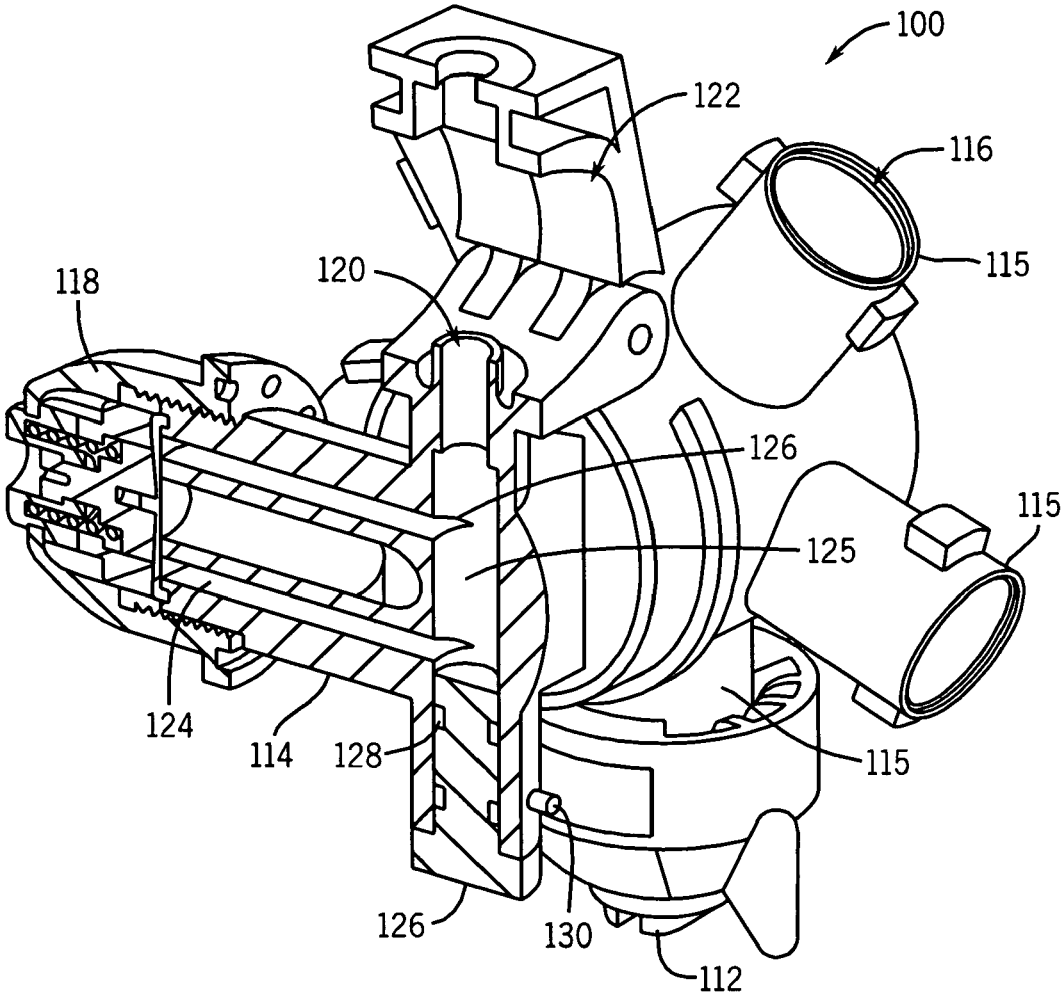
FIG. 2 is a cross-sectional perspective view of a nozzle body according to another embodiment of the invention.

FIG. 2 illustrates a nozzle body 100 according to another embodiment of the invention. The nozzle body 100 can include a main body 114, a turret 116, a valve assembly 118, a feed spigot 120, and a pipe clamp 122. One spray nozzle 112 is shown as an example attached to a port 115 of the turret 116 of the nozzle body 100. The nozzle body 100 is similar to the nozzle body 10 of FIG. 1. However, the nozzle body 100 can include a counterbore 125. The counterbore 125 can be created from the underside of the main body 114. The counterbore 125 can be capped by a plug 126 or another suitable component. In some embodiments, the plug 126 can be sealed with a radial o-ring 128 and retained with a dowel pin 130.

Various features and advantages of the invention are set forth in the following claims.

The invention claimed is:

1. A nozzle body comprising:

a main body;

a turret;

a valve assembly including a valve chamber; and a feed spigot in fluid communication with the valve chamber, the feed spigot including a first feed point and a second feed point separated from the first feed point, the first feed point in direct fluid communication with the valve chamber, the second feed point in direct fluid communication with the valve chamber in order to increase flow capacity.

2. The nozzle body of claim 1 wherein the first feed point is an upper feed point and the second feed point is a lower feed point.

3. The nozzle body of claim 1 wherein the first feed point communicates with a top side of the valve chamber and the second feed point communicates with a bottom side of the valve chamber.

4. The nozzle body of claim 1 wherein the main body and the feed spigot are a single molded piece.

5. The nozzle body of claim 1 wherein the main body includes a counterbore.

6. The nozzle body of claim 5 wherein the counterbore is capped by a plug.

7. The nozzle body of claim 6 wherein the plug is sealed by an o-ring and retained with a dowel pin.

8. The nozzle body of claim 1 wherein the turret is a multi-indexable turret.

9. The nozzle body of claim 1 wherein the valve assembly is a diaphragm check valve assembly.

10. The nozzle body of claim 1 wherein the turret includes at least three ports to receive at least three nozzles.

11. The nozzle body of claim 1 wherein at least one of the first feed point and the second feed point is substantially horizontally aligned with the feed chamber.

12. The nozzle body of claim 1 wherein the nozzle body is adapted to attach to a boom of an agricultural crop spraying machine in order to distribute agro-chemical spray.

* * * * *